US007780513B2

(12) United States Patent
Lin

(10) Patent No.: US 7,780,513 B2
(45) Date of Patent: Aug. 24, 2010

(54) BOARD GAME SYSTEM UTILIZING A ROBOT ARM

(75) Inventor: Chyi-Yeu Lin, Taipei (TW)

(73) Assignee: National Taiwan University of Science and Technology, Taipei (TW)

( * ) Notice: Subject to any disclaimer, the term of this patent is extended or adjusted under 35 U.S.C. 154(b) by 767 days.

(21) Appl. No.: 11/798,971

(22) Filed: May 18, 2007

(65) Prior Publication Data

US 2008/0214260 A1 Sep. 4, 2008

(30) Foreign Application Priority Data

Mar. 2, 2007 (TW) ..... 96107232 A

(51) Int. Cl.

| | |
|---|---|
| ***A63F 13/00*** | (2006.01) |
| ***A63F 3/00*** | (2006.01) |
| ***A63F 3/02*** | (2006.01) |
| ***A63F 9/00*** | (2006.01) |

(52) U.S. Cl. ..... 463/14; 700/900; 273/236; 273/260; 273/443; 901/2; 463/48

(58) Field of Classification Search ..... 463/14, 463/48; 901/2; 273/236, 260, 443; 434/128; 700/900

See application file for complete search history.

(56) References Cited

U.S. PATENT DOCUMENTS

| | | | | |
|---|---|---|---|---|
| 3,654,704 | A * | 4/1972 | Poglein | 33/18.2 |
| 4,178,698 | A * | 12/1979 | Cornell | 434/308 |
| 4,235,442 | A * | 11/1980 | Nelson | 273/237 |
| 4,398,720 | A * | 8/1983 | Jones et al. | 463/14 |
| 4,959,037 | A * | 9/1990 | Garfinkel | 446/299 |
| 5,573,245 | A * | 11/1996 | Weiner et al. | 273/153 R |
| 6,024,643 | A * | 2/2000 | Begis | 463/42 |
| 6,102,397 | A * | 8/2000 | Lee et al. | 273/238 |
| 6,523,629 | B1 * | 2/2003 | Buttz et al. | 180/167 |
| 6,580,246 | B2 * | 6/2003 | Jacobs | 318/568.16 |
| 6,584,375 | B2 * | 6/2003 | Bancroft et al. | 700/213 |
| 6,690,156 | B1 * | 2/2004 | Weiner et al. | 324/207.17 |
| 6,999,851 | B2 * | 2/2006 | Kato et al. | 700/245 |
| 7,137,861 | B2 * | 11/2006 | Carr et al. | 446/298 |

(Continued)

FOREIGN PATENT DOCUMENTS

JP 2008212617 A * 9/2008

OTHER PUBLICATIONS

Karim, Sadat, "Robot touchscreen analysis reveals differences between smartphones", Mar. 24, 2010, Neowin.net, pp. 2-7, accessed Jun. 5, 2010, <http://www.neowin.net/news/robot-touchscreen-analysis-reveals-differences-between-smartphones>.*

(Continued)

*Primary Examiner*—Peter DungBa Vo
*Assistant Examiner*—William H McCulloch
(74) *Attorney, Agent, or Firm*—Bacon & Thomas, PLLC

(57) ABSTRACT

A board game system comprises a touch screen, a computing device and a robot arm. The computing device comprises a processor and a memory. At least one type of board game program is stored in the memory so that the processor can execute the board game program present a corresponding board game interface on the touch screen. The robot arm controlled by the computing device can touch the touch screen and play the board game with a user.

19 Claims, 8 Drawing Sheets

U.S. PATENT DOCUMENTS

| | | | | |
|---|---|---|---|---|
| 7,206,753 | B2 * | 4/2007 | Bancroft et al. | 705/10 |
| 7,219,064 | B2 * | 5/2007 | Nakakita et al. | 704/275 |
| 7,289,882 | B2 * | 10/2007 | Lapstun et al. | 700/245 |
| 7,469,899 | B1 * | 12/2008 | Rogers et al. | 273/237 |
| 7,664,570 | B2 * | 2/2010 | Suita et al. | 700/245 |
| 2001/0001132 | A1 * | 5/2001 | Funda et al. | 700/245 |
| 2006/0211464 | A1 * | 9/2006 | Malobabic | 463/14 |
| 2007/0173974 | A1 * | 7/2007 | Lin | 700/245 |
| 2007/0192910 | A1 * | 8/2007 | Vu et al. | 901/17 |
| 2007/0199108 | A1 * | 8/2007 | Angle et al. | 901/17 |
| 2008/0144886 | A1 * | 6/2008 | Pryor | 382/103 |
| 2008/0214260 | A1 * | 9/2008 | Lin | 463/14 |
| 2008/0237983 | A1 * | 10/2008 | Chien | 273/260 |
| 2008/0255702 | A1 * | 10/2008 | Lin | 700/245 |
| 2008/0274769 | A1 * | 11/2008 | Linden | 455/556.1 |
| 2009/0017889 | A1 * | 1/2009 | Zhukov et al. | 463/14 |
| 2009/0177323 | A1 * | 7/2009 | Ziegler et al. | 700/259 |
| 2010/0013153 | A1 * | 1/2010 | Yourlo et al. | 273/237 |
| 2010/0045360 | A1 * | 2/2010 | Howard et al. | 327/365 |

OTHER PUBLICATIONS

"Robot Touchscreen Analysis", Mar. 23, 2010, MOTO Development Group Inc., pp. 8-15, accessed Jun. 5, 2010, <http://labs.moto.com/>.*

* cited by examiner

BOARD GAME SYSTEM UTILIZING A ROBOT ARM

BACKGROUND OF THE INVENTION

1. Field of the Invention

The present invention relates to a board game system that utilizes a robot arm.

2. Description of the Related Art

Numerous board game software programs have been developed that enable a user, with the aid of a computer, to play such board games as Chinese chess, chess, the game of "go", gobang, checkers or even more modern games, such as Monopoly. However, some users may find playing with a computer a little unreal or unnatural, and there are therefore prior art technologies relating to interactive board games relating to robots and people. An example is U.S. Pat. No. 4,398,720, entitled "Robot Computer Chess Game." Even though robot arms are a well developed technology, the robot arm disclosed in U.S. Pat. No. 4,398,720 is still very expensive. Furthermore, an added complexity is introduced when enabling the robot arm to grab different type of, different sized or different shaped pieces (since the gap or distance between two different pieces changes).

Moreover, U.S. Pat. No. 4,398,720 utilizes an actual chessboard, and hence different board games, different chessboards, pieces and control software programs are all required, which introduces significant complexity and requires a highly precise robot arm.

Therefore, it is desirable to provide a board game system utilizing a robot arm which is suitable for various board games and which reduces manufacturing cost and system complexity to mitigate and/or obviate the aforementioned problems.

SUMMARY OF THE INVENTION

A main objective of the present invention is to provide an interactive board game system that utilizes a robot arm.

In order to achieve the above-mentioned objective, the board game system of the present invention includes a touch screen, a computer device and a robot arm. The computing device comprises a processor and a memory, wherein the memory stores at least one type of board game program. The touch screen can display a board game interface of the board game program when the processor executes the board game program. The touch screen can display corresponding board game interfaces for different board games.

The robot arm comprises a contact end. When the board game program is executed, the computing device controls the robot arm to touch the touch screen with the contact end to interactively play the board game with one or multiple players (real persons).

Furthermore, the contact end comprises a cushioning mechanism and a safety sensor for reducing the probability of damaging the touch screen.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
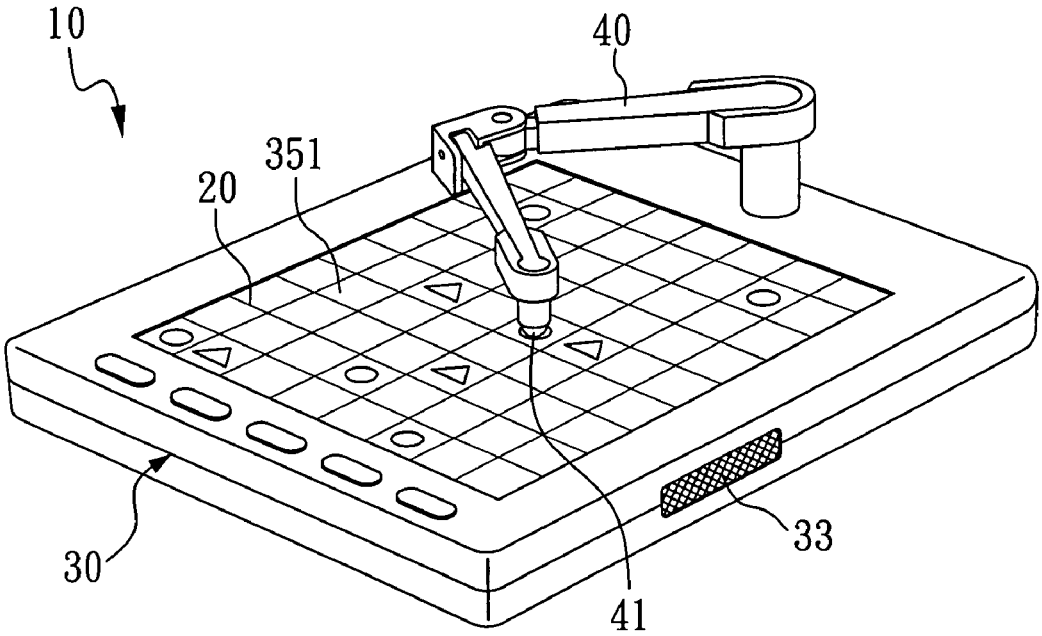
FIG. 1 is a schematic drawing of a first embodiment of a board game system according to the present invention.

The present invention is suitable for any board game, such as Chinese chess, chess, the game of "go", gobang, checkers, and even more recent games such as Monopoly and the like. These games all have a board with a particular pattern and a plurality of pieces that are moved by players according to specific game rules. The present invention is suitable for any game having the above-mentioned characteristics. In the present invention, a robot arm or a robot can be one of the players, and a touch screen is used to display the board and the pieces. Three embodiments are provided in the following description.

Please refer to FIG. 1 to FIG. 4 for a first embodiment.

A board game system 10 comprises a touch screen 20, a computing device 30 and a robot arm 40. In a first embodiment, the touch screen 20, the computing device 30 and the robot arm 40 are integrated together. The touch screen 20 and the computing device 30 are electrically connected together, and the robot arm 40 is also electrically connected to the computing device 30.

The computing device 30 may comprise a processor 31, a memory 32 (such as DRAM, a hard disk or both) and a speaker 33. The memory 32 stores at least one board game program 35. When the processor 31 executes the board game program 35, the processor 31 controls the touch screen 20 to display a game interface 351 that corresponds to the board game program 35. The speaker 33 may be used for entertainment purpose, such as providing sound effects or dialog during the game.

The board game program 35 may implement one or more of any suitable board games, such as Chinese chess, chess, the game of "go", gobang, checkers, etc. Since many different board game programs are possible, it is beyond the scope of this disclosure to describe the board game program 35 that may be implemented. Taking chess games as an example, the touch screen 20 may be used as a board, while the arrangement of the board and the pieces are presented as images displayed on the touch screen 20. As a result, the board game system 10 can provide various types of chess games for one or multiple players.

The robot arm 40 of the present invention comprises a contact end 41. When the board game program 35 is executed, the computing device 30 controls the robot arm 40 to cause the contact end 41 of the robot arm 40 to touch a "piece" displayed on the touch screen 20 at a first position; such contact may indicate that the "piece" has been picked up, for example. Then, the computing device 30 may control the robot arm 40 to move to a second position to touch the touch screen 20, which may indicate that this "piece" has been put down at that second position, for example. The computing device 30 may automatically send out various other responses according to the resulting change of the position of the "piece" and the current condition of the board as presented on the touch screen 20, such as capturing an original "piece" at the second position, providing a warning that a "check" condition is present, inviting the next player to make a move, etc. Therefore, the present invention provides a board game system 10 that can play various board games with one or multiple players (real persons).

Figure 2:
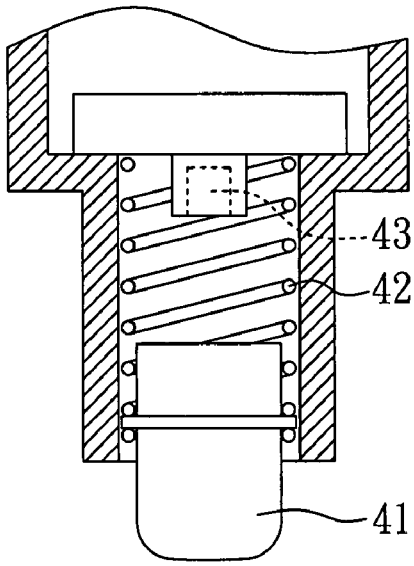
FIG. 2 is a cross-sectional drawing of a contact end of a robot arm according to the present invention.
Figure 3:
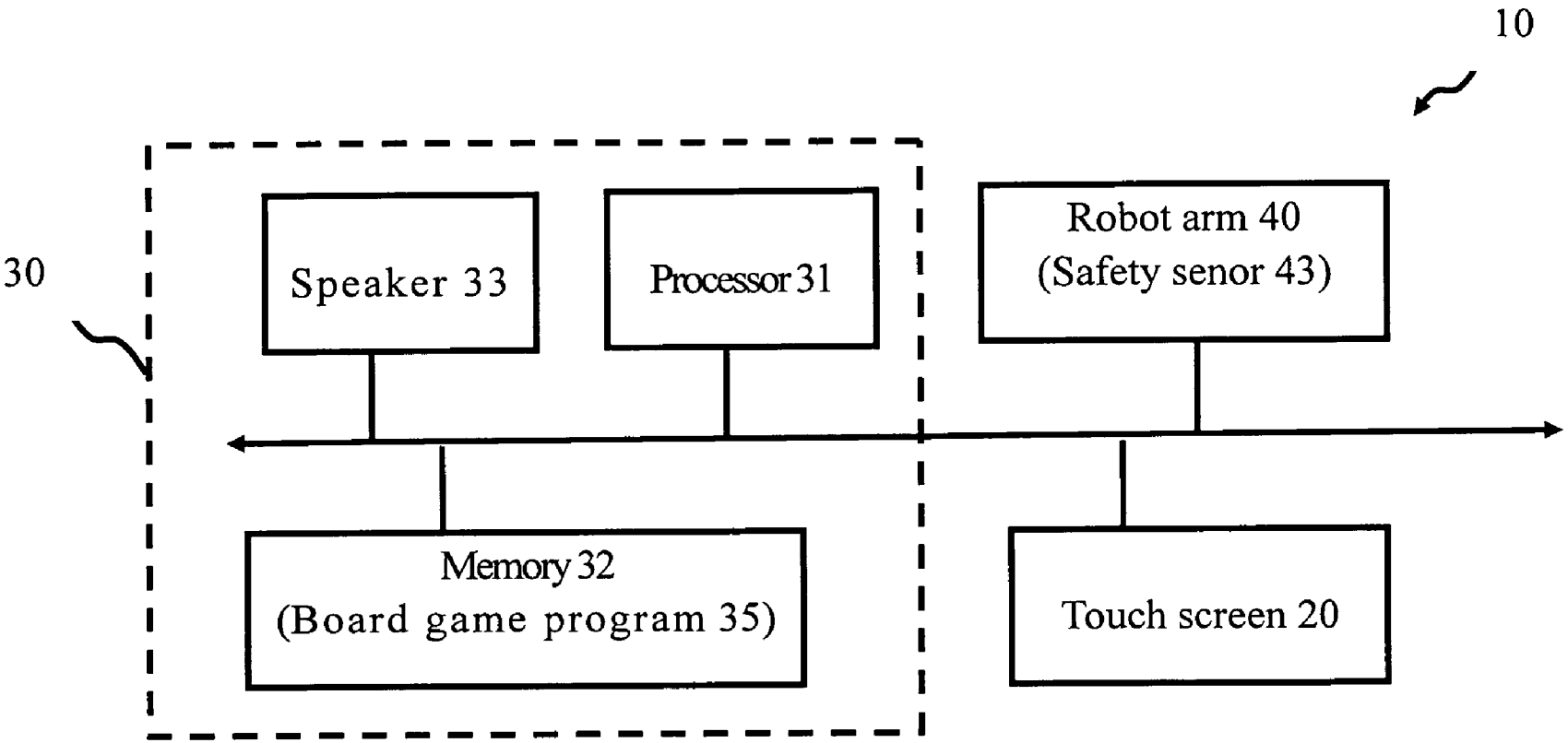
FIG. 3 is a hardware diagram of a first embodiment of a board game system according to the present invention.

There are, for example, two types of touch screens 20: one type of touch screen 20 can be activated by any physical touching of the screen, while the other type of touch screen 20 is only activated by a sensing pen. The sensing pen for the second type can activate the touch screen 20 when placed in close proximity to the screen. Robot arms 40 currently have very precisely controllability, so it's very unlikely that the robot arm 40 would damage the touch screen 20. However, to reduce the probability of any damage to the touch screen 20, as shown in FIG. 2, the contact end 41 is preferably is made of a resilient material, such as rubber. Furthermore, a cushioning mechanism 42 (such as a spring) may be added onto the robot arm 40 to provide greater tolerances for operational error. A safety sensor 43 may also be added to the robot arm 40 so that if the contact end 41 touches the touch screen 20 too hard, the contact end 41 will also activate the safety sensor 43 (such as by pressing a button or switch), and the safety sensor 43 may then send a signal to cause the computing device 30 to move the robot arm 40 in an opposite direction or return the robot arm 40 back to a home or default position. Step 403 in the following provides additional details. The safety sensor 43 may not only prevent the robot arm 40 from damaging the touch screen 20 but may also prevent the robot arm 40 from pressing against the players.

Figure 4:
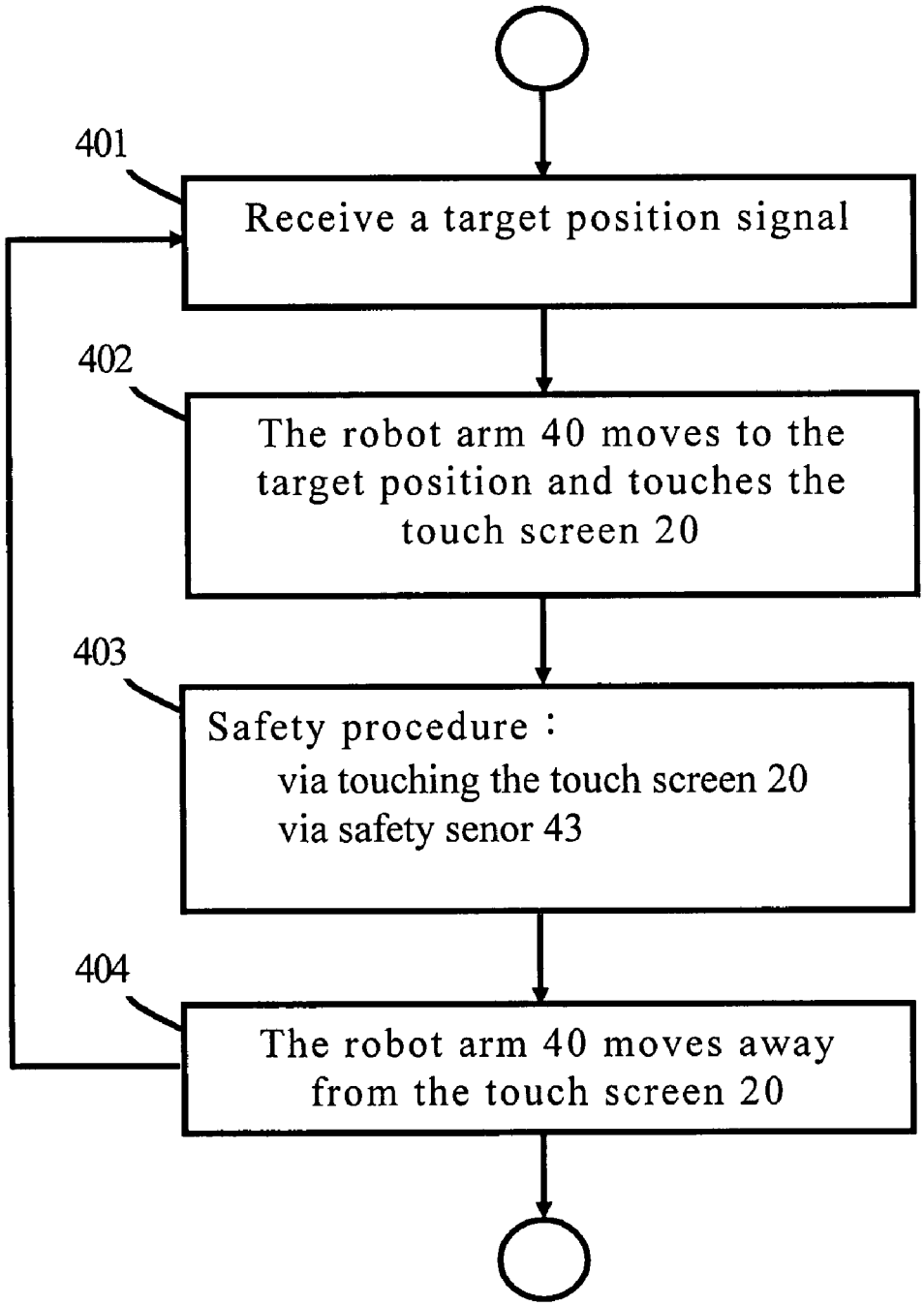
FIG. 4 is a flowchart of the movement of a robot arm.

Please refer to FIG. 4. FIG. 4 is a flowchart of the movement of the robot arm.

Step 401:

The robot arm 40 receives a target position signal from the computing device 30.

The board game program 35 is designed to be able to calculate to next move for the computer as an opponent; for example, the program will calculate which piece needs to be moved and how to move that piece. Afterwards, the desired position is converted to a target position for the robot arm 40 (typically, a corresponding coordinate on the touch screen 20 is obtained, which converts to different angles for the motors in the robot arm). Since control technology for the robot arm 40 is a well-known technology, no further description is required.

Step 402:

The robot arm 40 moves to the target position and touches the touch screen 20.

Step 403:

This step is a safety procedure, which may include:

a first procedure during which so long as the touch screen 20 senses a touch, the robot arm 40 is required to returned to the home position; and the second procedure during which the contact end 41 activates the safety sensor 43 (such as by pressing upon the safety sensor 43), and the safety sensor 43 sends a signal to the computing device 30 to cause the robot arm 40 to return to the home position.

One of the above-mentioned two procedures may be used, or both of them may be used.

If an abnormal condition arises and step 403 needs to be executed, a warning may be sent to the user to request that an adjustment procedure for the robot arm 40 be performed.

However, the current control technology for the robot arm 40 is typically very precise, so step 403 may not be necessary.

Step 404: After the robot arm 40 arrives at the target position, the robot arm 40 moves away from the touch screen 20. In the next step, the robot arm 40 may return back to the home position first or may keep moving to a next target position from a prior target position signal.

Additionally, in step 401, more than one target position signal may be received, and the robot arm 40 may thus move to different target positions in the order in which the target position signals are received. The robot arm 40 may additionally be attached to a humanoid-like toy (not shown in the figure), in which the robot arm 40 may serve as the arm of the toy.

Figure 5:
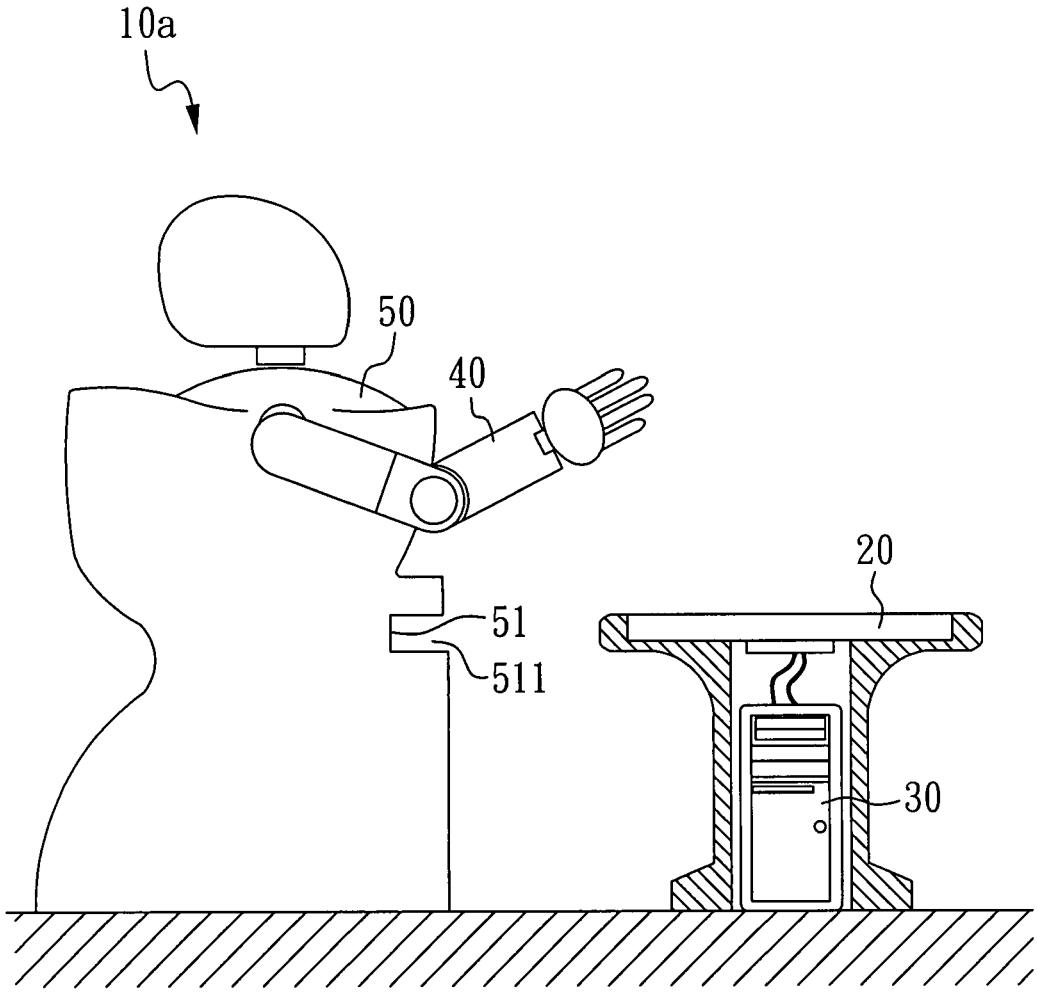
FIG. 5 is a schematic drawing of a second embodiment of a board game system according to the present invention, which shows a robot apparatus and a touch screen when not combined together.
Figure 6:
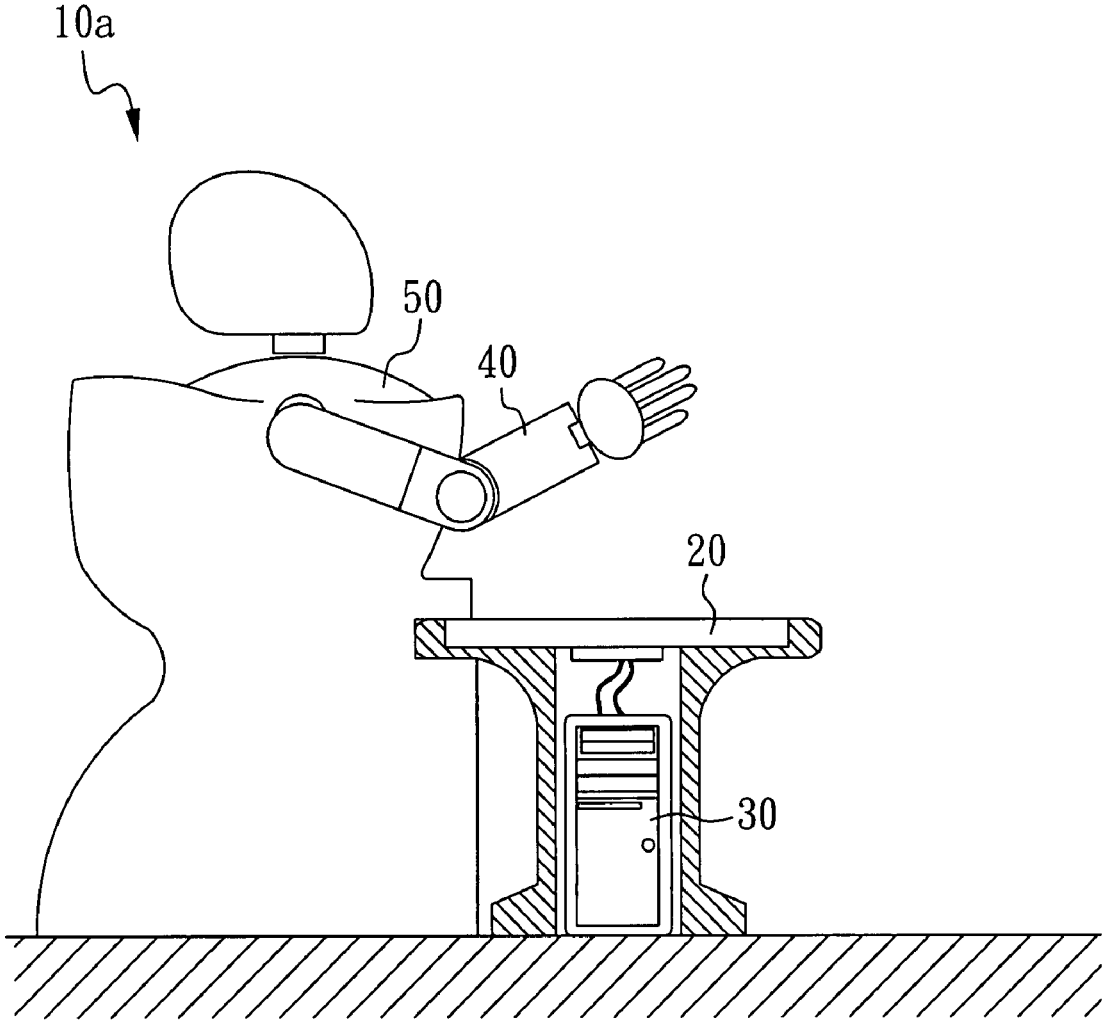
FIG. 6 is a schematic drawing of the second embodiment of a board game system according to the present invention, which shows the robot apparatus and the touch screen combined together.
Figure 7:
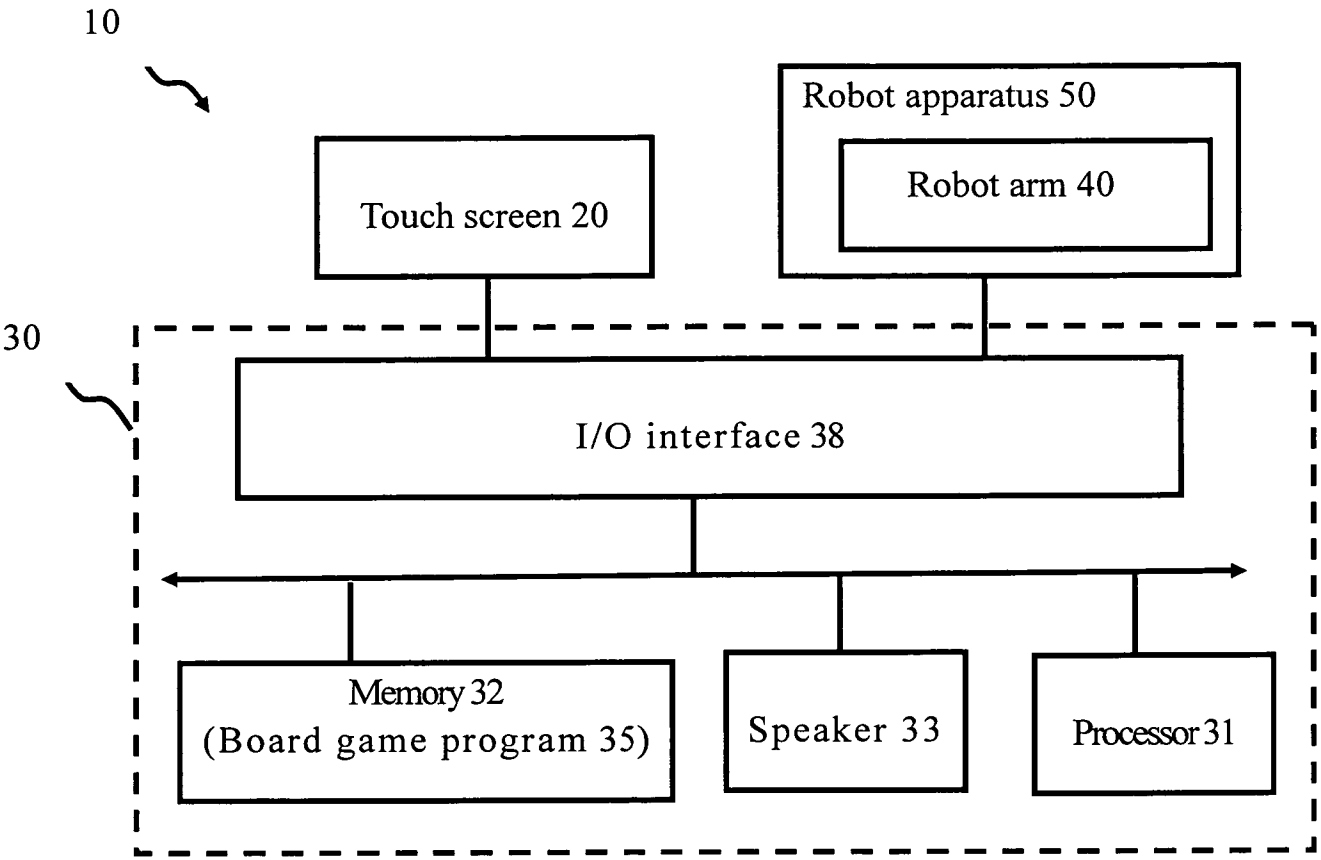
FIG. 7 is a hardware diagram of the second embodiment of a board game system according to the present invention.

Please refer to FIG. 5 to FIG. 7. A board game system 10*a* comprises a robot apparatus 50, in which the robot arm 40 is part of the robot apparatus 50. The robot apparatus 50 may be designed for other purposes. When a board game is to be played, a connection interface 51 of the robot apparatus 50 and an I/O interface 38 of the computing device 30 may be connected together. FIG. 5 is a schematic drawing of a second embodiment of a board game system according to the present invention, which shows the robot apparatus and the touch screen when not combined together.

FIG. 6 is a schematic drawing of the second embodiment of the board game system according to the present invention, in which the robot apparatus and the touch screen are shown combined together. In this embodiment, the connection interface 51 of the robot apparatus 50 has a slot 511 for connecting with the touch screen 20. When the robot apparatus 50 and the touch screen 20 are connected together, a relative positional relationship between the robot arm 40 and the touch screen 20 is also thereby created. However, the relative position al relationship between the robot arm 40 and the touch screen 20 may be determined by other methods; for example, the robot apparatus 50 may comprise an image capturing device and image analysis software that may be used to obtain the position of the touch screen 20. A difference between the second embodiment and the first embodiment is that in the second embodiment it is not necessary for the robot arm 40 to be firmly or permanently connected to the touch screen 20.

Figure 8:
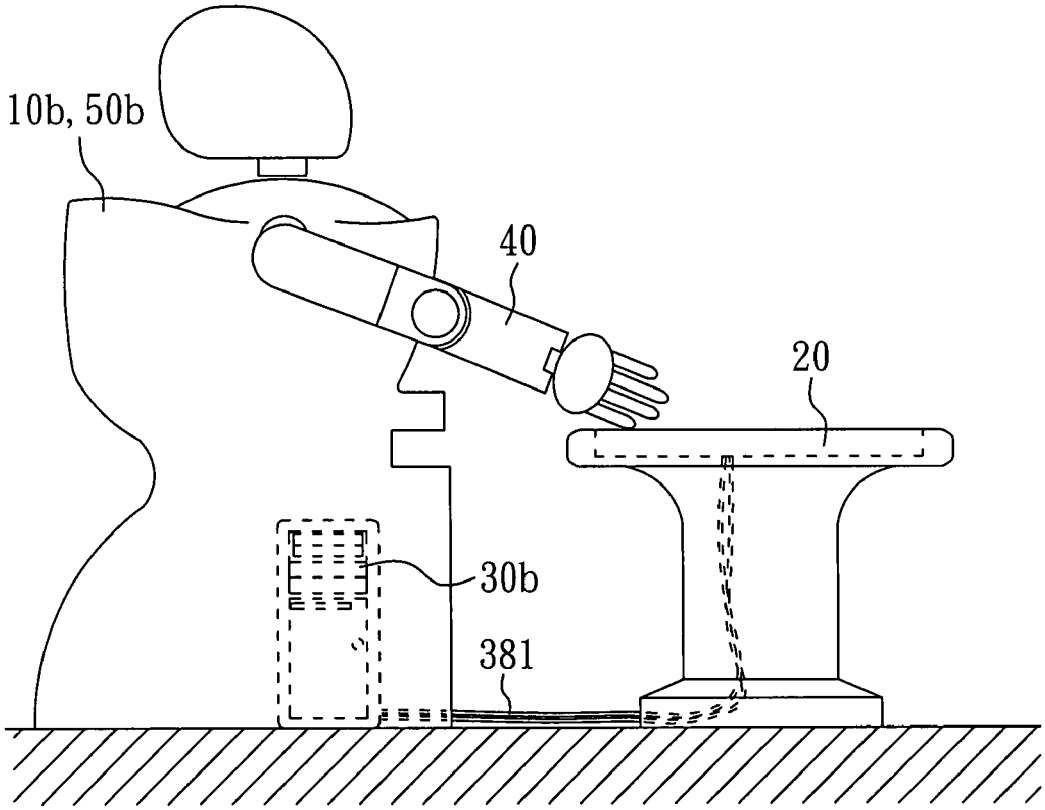
FIG. 8 is a schematic drawing of a third embodiment of a board game system according to the present invention.
Figure 9:
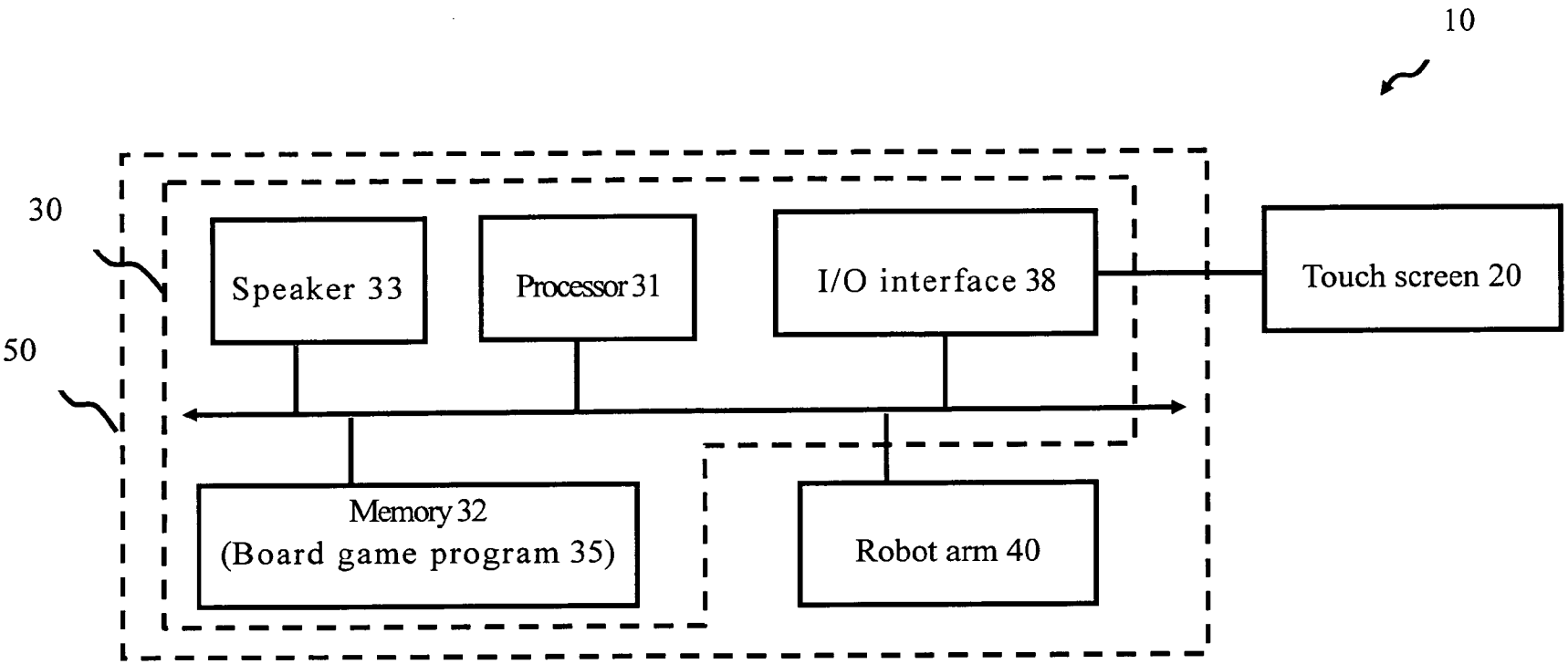
FIG. 9 is a hardware diagram of the third embodiment of a board game system according to the present invention.

Please refer to FIG. 8 and FIG. 9. In a third embodiment, the board game program of a board game system 10*b* can be executed by a computing device 30*b* in the robot apparatus 50*b*, and the board game system 10*b* does not necessarily comprise the touch screen 20 because it can be connected to the touch screen 20 via a cable 381. However, the robot apparatus 50*b* can also be designed to include the touch screen 20, and the touch screen 20 may be folded up, and may be opened by the player.

The present invention may also be suitable for various card games (such as Machang), because these card games generally require no boards but only cards, which are equivalent to the pieces in board games. Therefore, the present invention may utilize different versions of card game software for one or multiple players.

Although the present invention has been explained in relation to its preferred embodiment, it is to be understood that many other possible modifications and variations can be made without departing from the spirit and scope of the invention as hereinafter claimed.

What is claimed is:

1. A board game system comprising:

a computing device comprising a processor and a memory, wherein the memory stores at least one type of board game program so that the processor can execute the board game program;

a touch screen electrically connected to the computing device and used for displaying a corresponding board game interface of the board game program when the board game program is executed; and a robot arm electrically connected to the computing device and comprising a contact end;

wherein when the board game program is executed, the computing device controls the robot arm to touch the touch screen with the contact end to interactively play the board game with a user.

2. The board game system as claimed in claim 1, wherein the contact end comprises a cushioning mechanism for reducing the probability of damaging the touch screen.

3. The board game system as claimed in claim 2, wherein the contact end comprises a safety sensor for reducing the probability of damaging the touch screen.

4. The board game system as claimed in claim 3, wherein the robot arm and the touch screen are fixed together.

5. The board game system as claimed in claim 1, wherein the robot arm and the touch screen are fixed together.

6. The board game system as claimed in claim 1 further comprising a robot apparatus, wherein the robot arm is connected to the robot apparatus.

7. The board game system as claimed in claim 6, wherein the computing device is external to the robot apparatus, and the computing device and the robot apparatus are electrically connected to each other.

8. The board game system as claimed in claim 7, wherein the contact end comprises a cushioning mechanism for reducing the probability of damaging the touch screen.

9. The board game system as claimed in claim 8, wherein the contact end comprises a safety sensor for reducing the probability of damaging the touch screen.

10. The board game system as claimed in claim 6, wherein the computing device is disposed inside the robot apparatus.

11. The board game system as claimed in claim 10, wherein the contact end comprises a cushioning mechanism for reducing the probability of damaging the touch screen.

12. The board game system as claimed in claim 11, wherein the contact end comprises a safety sensor for reducing the probability of damaging the touch screen.

13. The board game system as claimed in claim 1, wherein when the touch screen senses the contact end of the robot arm, the computing device controls the robot arm to move away from the touch screen to reduce the probability of damaging the touch screen.

14. The board game system as claimed in claim 1, wherein the contact end comprises a safety sensor, and when the safety sensor is trigged, the computing device controls the robot arm to move away from the touch screen to reduce the probability of damaging the touch screen.

15. A robot apparatus electrically connected to a touch screen for interactively playing a board game with a user, the robot apparatus comprising:

a computing device comprising a processor and a memory, wherein the memory stores at least one type of board game program so that the processor can execute the board game program, and the touch screen displays a corresponding board game interface of the board game program when the board game program is executed; and a robot arm electrically connected to the computing device and comprising a contact end;

wherein when the board game program is executed, the computing device controls the robot arm to touch the touch screen with the contact end to interactively play the board game with a user.

16. The robot apparatus as claimed in claim 15, wherein the contact end comprises a cushioning mechanism for reducing the probability of damaging the touch screen.

17. The robot apparatus as claimed in claim 16, wherein the contact end comprises a safety sensor for reducing the probability of damaging the touch screen.

18. The robot apparatus as claimed in claim 15, wherein when the touch screen senses the contact end of the robot arm, the computing device controls the robot arm to move away from the touch screen to reduce the probability of damaging the touch screen.

19. The robot apparatus as claimed in claim 15, wherein the contact end comprises a safety sensor, and when the safety sensor is trigged the computing device controls the robot arm to move away from the touch screen to reduce the probability of damaging the touch screen.

* * * * *